US010443321B2

(12) United States Patent
Cravatte et al.

(10) Patent No.: US 10,443,321 B2
(45) Date of Patent: Oct. 15, 2019

(54) TORQUE AND TORSION LIMITING TOOL

(71) Applicant: SICENO S.A.R.L., Weiswampach (LU)

(72) Inventors: Philippe Louis Cravatte, Malmedy (BE); Michael Bocklandt, Malmedy (BE)

(73) Assignee: Siceno S.a.r.l., Weiswampach (LU)

( * ) Notice: Subject to any disclaimer, the term of this patent is extended or adjusted under 35 U.S.C. 154(b) by 144 days.

(21) Appl. No.: 15/324,210

(22) PCT Filed: Jul. 17, 2015

(86) PCT No.: PCT/EP2015/066474

§ 371 (c)(1),
(2) Date: Jan. 5, 2017

(87) PCT Pub. No.: WO2016/009068

PCT Pub. Date: Jan. 21, 2016

(65) Prior Publication Data

US 2017/0204684 A1 Jul. 20, 2017

(30) Foreign Application Priority Data

Jul. 18, 2014 (GB) ..... 1412778

(51) Int. Cl.
*E21B 17/07* (2006.01)
*E21B 4/02* (2006.01)

(52) U.S. Cl.
CPC ..... *E21B 17/073* (2013.01); *E21B 17/076* (2013.01); *E21B 4/02* (2013.01)

(58) Field of Classification Search
CPC ..... E21B 17/07; E21B 17/073; E21B 17/076
See application file for complete search history.

(56) References Cited

U.S. PATENT DOCUMENTS 4,413,516 A * 11/1983 Croom, Jr. ..... E21B 47/011 33/304
7,654,344 B2 * 2/2010 Haughom ..... E21B 17/073 175/322

(Continued)

FOREIGN PATENT DOCUMENTS

CA 2402035 A1 * 3/2004 ..... E21B 17/073
CA 2402035 A1 3/2004

(Continued)

OTHER PUBLICATIONS

PCT Search Report & Written Opinion (PCT/EP2015/066474), dated Nov. 23, 2015.

*Primary Examiner* — Robert E Fuller
*Assistant Examiner* — Theodore N Yao
(74) *Attorney, Agent, or Firm* — Gregory L. Porter; Hunton Andrews Kurth LLP

(57) ABSTRACT

A downhole tool (30) particularly for controlling torque and torsion and also for absorbing/dampening vibration in a downhole string is provided and comprises an inner mandrel (1, 7, 11, 15) and an outer mandrel (14, 13, 12, 19) and a coupling mechanism (8) to couple the inner and the outer mandrel, the coupling mechanism comprising one or more longitudinally elongate members (8) acting between the inner and outer mandrel, wherein the one or more longitudinally elongate members are substantially fixed in their longitudinal length but substantially do not resist relative compressive longitudinal movement occurring between the inner and outer mandrels. The coupling mechanism is arranged such that compression of the inner and outer mandrels results in compression of the one or more longitudinally elongate members without necessarily resulting in relative rotation of the inner and outer mandrels.

29 Claims, 8 Drawing Sheets

(56) References Cited

U.S. PATENT DOCUMENTS

| | | | | |
|---|---|---|---|---|
| 2012/0228029 | A1 | 9/2012 | Reimers | |
| 2013/0220701 | A1 | 8/2013 | Crowley | |
| 2016/0348472 | A1* | 12/2016 | Gosselin | E21B 37/00 |

FOREIGN PATENT DOCUMENTS

| | | | | |
|---|---|---|---|---|
| CN | 106567681 | A | * | 4/2017 |
| GB | 2439177 | A | | 12/2007 |
| WO | 1998040599 | A1 | | 9/1998 |

* cited by examiner

TORQUE AND TORSION LIMITING TOOL

CROSS-REFERENCES

This application is a national phase application under 35 U.S.C. 371, claiming priority to PCT/EP2015/066474, filed Jul. 17, 2015, which claims priority to GB Application No. 1412778.1, filed Jul. 18, 2014.

BACKGROUND AND SUMMARY OF THE INVENTION

The present invention relates to a downhole tool for use in a drill string when drilling a wellbore with a drill bit and particularly but not exclusively relates to a torque and/or torsion limiting tool for protecting a drilling mud motor and other drill string components from experiencing excessive torque and/or for preventing the halt of a drilling operation due to excessive torque and/or torsion being experienced by a drilling mud motor and other drill string components and/or provides a shock absorber and/or vibration dampener to the drilling mud motor and other drill string components.

It has been known for many years to use a drill bit provided on the end of a drill string of lengths of drill pipe to drill a wellbore particularly for hydrocarbon exploration and exploitation where the drill string is rotated at surface. In more recent years, it has also been known to use a drill string comprising a long length of coiled tubing having a drill bit mounted at the lower end thereof where the drill bit is not rotated from surface but is rotated by a downhole motor driven by drilling mud being pumped from the surface. Alternatively, mud motors may also be used with a conventional drill string comprising lengths of drill pipe. In each case, there is typically a maximum value of torque that the drill string can safely experience, the torque being delivered either from the surface by rotation of the drill string or by the downhole motor and being mainly generated by the drill bit reacting against the formation. Additionally, when the wellbore is drilled with a downhole mud motor, if the torque exceeds a particular value then the mud motor is liable to stall and if that occurs then the operator needs to stop the drilling process, needs to pull up the drill string to lift the drill bit off the bottom of the hole and then restart the drilling mud pumps to restart the mud motor and therefore rotate the drill bit again and that process all takes time.

In order to avoid the aforementioned problems, it is known to use torque limiting tools which are those disclosed in Patent Numbers GB2439177, GB2439178 and WO2012/121608. Such conventional torque limiting tools typically comprise a screw thread arrangement and a separate spring acting between two parts of a tool wherein relative torque acting between the two parts causes rotation of one of the screw threaded members relative to the other which in turn causes compression of the spring and thereby causes relative axial movement of one of the screw threaded members relative to the other to thereby reduce the length of the torque limiting tool in order to lift the drill bit off the bottom of the borehole when the torque limiting tool experiences a level of torque above a predetermined value.

In the case of the screw threaded members of, e.g. WO2012/121608, they will act like a nut threaded onto a bolt and therefore applying weight on the bit may or may not result in rotation of the nut on the bolt because such rotation depends upon the level of friction acting between the nut and the bolt and also upon the pitch of the threads between the nut and the bolt plus other factors of the screw threaded connection.

Consequently, it is an object of the present invention to mitigate such disadvantages with such a screw threaded connection in a torque control tool.

An earlier conventional torque limiting tool is shown in GB2435386 and more simply comprises helically arranged spring elements acting between an upper and a lower part of the tool wherein relative torque acting between the upper and lower parts causes relative rotation of the upper and lower parts of the tool which results in an axial movement thereof. Also, US2007/0000695 discloses a key and slot arrangement which combine to provide a lead screw coupling mechanism. Accordingly, the tools of GB2435386 and US2007/0000695 may suffer from the disadvantage that the action of setting down weight on bit results in potentially unwanted rotation of the bit.

Additionally, such prior art linear screw thread type tools have the disadvantage that they provide the same level of sensitivity (i.e. provide the same distance of axial stroking action) at lower levels of torque experienced by the downhole tool compared with higher levels of torque experienced by the downhole tool and therefore are only able to provide a linear response to axial movement no matter what the level of torque experienced by the tool.

According to the present invention there is provided a downhole tool comprising an inner mandrel and an outer mandrel, and one or more longitudinally elongate members acting between the inner and outer mandrel, wherein the one or more longitudinally elongate members are substantially fixed in their longitudinal length but substantially do not resist relative compressive longitudinal movement occurring between the inner and outer mandrels.

According to the present invention there is also provided a coupling mechanism for coupling an inner mandrel of a downhole tool to an outer mandrel of the downhole tool, the coupling mechanism comprising:

one or more longitudinally elongate members arranged, in use to act between the inner and outer mandrel, wherein the one or more longitudinally elongate members are substantially fixed in their longitudinal length but substantially do not resist relative compressive longitudinal movement occurring between the inner and outer mandrels; and wherein the coupling mechanism is arranged such that compression of the inner and outer mandrels in use thereof results in compression of the one or more longitudinally elongate members without necessarily resulting in relative rotation of the inner and outer mandrels.

Preferably, the one or more longitudinally elongate members provide a differential in their reaction to tension and compression and more preferably the one or more longitudinally elongate members substantially permit compression along their length without substantial resistance and substantially resist tension applied along their length. Typically, the one or more longitudinally elongate members provide a reactive force which resists tension but provides a substantially reduced resistive force when in compression.

Typically, the one or more longitudinally elongate members substantially permit compression of their length without substantial resistance and typically, will fold, crumple, curl or scrunch up or otherwise flexibly collapse when compressed at one end relative to the other. More preferably, the one or more longitudinally elongate members are substantially inelastic when in tension and more preferably, the one or more longitudinally elongate members do not substantially increase in longitudinal length when tension is applied to one end relative to another. Typically, compression of the inner and outer mandrels results in telescoping movement of the inner mandrel into the outer mandrel without necessarily resulting in relative rotation of the inner and outer mandrels. Preferably the coupling mechanism does not comprise a lead screw arrangement and typically the coupling mechanism does not comprise a rotational locking arrangement such as a spline mechanism. Typically, the coupling mechanism permits at least a certain degree of relative rotational movement between the inner and outer mandrels. Preferably, the coupling mechanism permits relative rotational movement between the inner and outer mandrels between a first configuration in which the downhole tool is relatively untorqued and a second configuration in which the downhole tool is relatively fully torqued. Preferably, when the tool is in the first configuration the inner mandrel is not necessarily stroked into the outer mandrel and when the tool is in the second configuration the inner mandrel is stroked into the outer mandrel.

Preferably, the one or more elongate members are adapted to transfer force in one axial direction but not in another and more preferably, are adapted to transfer force when in tension (that is when the ends of the elongate member are pulled apart) but not in compression (that is when the ends of the elongate member are pushed toward one another). Preferably, the one or more elongate members are inelastic in one axial direction but not in the other axial direction and more preferably, the one or more elongate members are axially inextensible in said one axial direction and are axially compressible in the said other axial direction and most preferably, the one or more elongate members are axially inextensible when in tension (that is when the ends of the elongate member are pulled apart) and are axially compressible in compression (that is when the ends of the elongate member are pushed toward one another).

Preferably, the downhole tool comprises a downhole torque control tool. Alternatively or additionally, the downhole tool preferably comprises a downhole shock absorber tool. Alternatively or additionally, the downhole tool preferably comprises a downhole axial vibration dampener tool. Alternatively or additionally, the downhole tool preferably comprises a downhole torsion control tool. Most preferably, the downhole tool comprises a combined downhole, torsional and axial vibration dampener.

Typically, the downhole tool is adapted to be included in a downhole tool string, typically with a downhole mud motor and/or a downhole drill bit.

Preferably, there are at least two and preferably more than two longitudinally elongate members. Preferably, the plurality of longitudinally elongate members are arranged around the longitudinal axis of the downhole tool and more preferably are arranged substantially equi-spaced around a co-diameter of the longitudinal axis of the downhole tool.

Preferably, one end of the plurality of longitudinally elongate members is securely mounted to the inner mandrel and the other end of the plurality of longitudinally elongate members is securely mounted to the outer mandrel.

Preferably, the plurality of longitudinally elongate members are arranged substantially equi-spaced around a co-diameter of the longitudinal axis of the downhole tool such that the upper ends of the plurality of longitudinally elongate members terminate on an upper plane that is perpendicular to the longitudinal axis of the downhole tool and the lower ends of the plurality of longitudinally elongate members terminate on a lower plane that is perpendicular to the longitudinal axis of the downhole tool; and wherein the upper and lower planes are spaced apart by the longitudinal distance between the said upper and lower ends; and relative rotation of the said upper ends on their upper plane about the longitudinal axis of the downhole tool with respect to the lower ends on their lower plane by alpha degree(s) of rotation to cover alpha degree(s) of arc results in the plurality of longitudinally elongate members comprising a helical configuration having a certain first longitudinal distance between the upper and lower planes.

Typically, further relative rotation of the upper ends on their upper plane about the longitudinal axis of the downhole tool with respect to the lower ends on their lower plane by beta degree(s) of rotation to cover beta degree(s) of arc results in the plurality of longitudinally elongate members comprising a tighter helical configuration having a certain second longitudinal distance between the upper and lower planes. Typically, yet further relative rotation of the upper ends on their upper plane about the longitudinal axis of the downhole tool with respect to the lower ends on their lower plane gamma degree(s) of rotation to cover gamma degree(s) of arc results in the plurality of longitudinally elongate members comprising a yet tighter helical configuration having a certain third longitudinal distance between the upper and lower planes.

Typically, the one or more elongate members are arranged such that their pitch is not constant, in that a given rotational arc of movement of the upper ends on their upper plane does not always produce the same distance of axial movement. Preferably, the one or more elongate members are arranged such that where said alpha, beta and gamma degrees are identical, the translation or difference in distance between the first and second longitudinal distances is less than the translation or difference in distance between the second and third longitudinal distances. Preferably, the pitch of the plurality of longitudinally elongate members increases as the inner mandrel telescopes or strokes further into the outer mandrel.

This provides embodiments of the present invention with the great advantage that they are less sensitive (i.e. provide less of an axial stroking action) at lower levels of torque experienced by the downhole tool compared with being more sensitive (i.e. provide more of an axial stroking action) at higher levels of torque experienced by the downhole tool and therefore act to lift the drill bit off the formation to be drilled at higher levels of torque by a greater axial distance than could have otherwise been achieved by a conventional lead screw arrangement and therefore provides additional protection to the drill string when it needs it most (i.e. at the higher levels of torque). This is in contrast to conventional, prior art torque tools which for example employ a lead screw arrangement which necessarily has a constant pitch screw thread and which therefore has the disadvantage of only being able to provide a linear response to axial movement no matter what the level of torque experienced by the tool.

Preferably, the torque control tool is a torque restriction tool. It should be noted that the use of the term torque includes torsion acting upon the downhole tool and therefore the downhole tool comprises a torsion control tool.

Preferably, the biasing device is arranged to absorb or dampen shock and/or vibration experienced by the downhole tool in use, and therefore provides the tool with a dual shock/vibration absorbing/dampening function and torque (and preferably torsion) control function.

Preferably, the downhole tool further comprises a biasing device acting between the inner and outer mandrel. More preferably, the biasing device is a separate component from the one or more elongate members.

Preferably the biasing device acts to bias the inner mandrel out of the outer mandrel and acts to resist relative compressive movement of the inner mandrel into the outer mandrel. Preferably, the inner mandrel is arranged telescopingly within the outer mandrel. The biasing device may comprise one or more springs and more preferably comprises a plurality of belleville springs.

Preferably, the biasing device is arranged to enable rotation of the inner mandrel relative to the outer mandrel once a certain (and typically pre-determined) level of relative torque is experienced by the inner and outer mandrel and thus the biasing device permits the said rotation of one end of the plurality of longitudinally elongate members relative to the other.

In the description that follows, like parts are marked throughout the specification and drawings with the same reference numerals, respectively. The drawings are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper", or "upstream" meaning away from the bottom of the wellbore along the longitudinal axis of a work string toward the surface and "below", "down", "downward", "lower", or "downstream" meaning toward the bottom of the wellbore along the longitudinal axis of the work string and away from the surface and deeper into the well, whether the well being referred to is a conventional vertical well or a deviated well and therefore includes the typical situation where a rig is above a wellhead, and the well extends down from the wellhead into the formation, but also horizontal wells where the formation may not necessarily be below the wellhead. Similarly 'work string' refers to any tubular arrangement for conveying fluids and/or tools from a surface into a wellbore. In the present invention, coiled tubing or drill string is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents, and additional subject matter not recited, and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the downhole torque control tool are understood to include plural forms thereof and vice versa.

BRIEF DESCRIPTION OF DRAWINGS

Embodiments of the present invention will now be described, by way of example only, with reference to the accompanying drawings, in which.

DETAILED DESCRIPTION OF INVENTION

Figure 1:
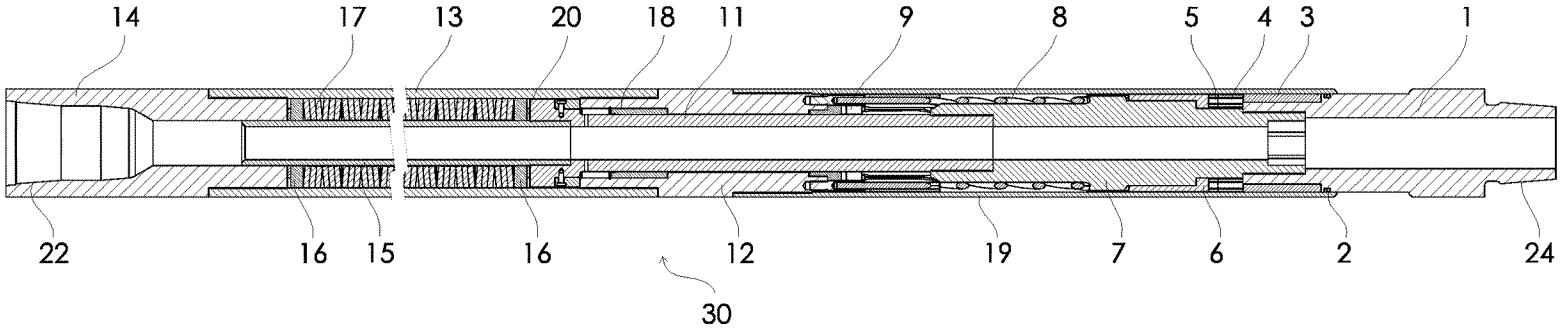
FIG. 1 is a cross sectional side view through a torque control tool in accordance with the present invention, wherein the torque control tool is shown in an at rest configuration where there is no relative torque occurring between an upper end and a lower end of the torque control tool and the torque control tool is fully stroked out and is at its maximum overall length.

A torque control tool 30 is shown in FIG. 1 in a relaxed or at rest configuration in which there is minimal or no relative torque occurring between its two ends 22, 24 and therefore there is no or only minimal compression in the longitudinal direction occurring between its two ends 22, 24.

The tool 30 comprises an upper end 22 having a suitable and typically conventional screw threaded connection such as a box connection in accordance with the American Petroleum Institute (API) standard OCTG screw threaded connection for oil field goods and furthermore having at its lower in use end 24 another suitable connection such as a screw threaded pin connection in accordance with the API OCTG screw threaded connections standard to enable the torque control tool 30 to be included in a string of downhole tubulars, typically in the bottom hole assembly (BHA), in relatively close proximity to the drill bit (not shown) which will typically be located below the lowermost end 24 and possibly connected to the lowermost end 24. In use, the torque control tool 30 will typically be located between a drill bit and a downhole mud motor or it can be located above both the drill bit and the downhole motor and as will be described, will act to prevent the mud motor and/or any other drill string or BHA components experiencing levels of torque above a particular predetermined value which may either damage one or both of the mud motor and/or any other drill string or BHA components or prevent either the mud motor or the drill bit from operating to their optimum performance.

The upper box connection 22 at the upper end 22 is formed in a top sub 14 and which is fixed at its lower end to the upper end of a belleville spring housing 13 via suitable connection such as a screw threaded connection and where the lower end of the belleville spring housing 13 is in turn connected via a suitable fixed connection such as a screw threaded connection to the upper end of a top cable anchor 12. The lower end of the top cable anchor 12 is in turn connected via a suitable connection such as screw threaded connection to the upper end of an outer sleeve 19. Thus, the top sub 14, the belleville spring housing 13, the top cable anchor 12 and the outer sleeve 19 form an outer mandrel 14, 13, 12, 19 of the torque control tool 30.

Figure 2:
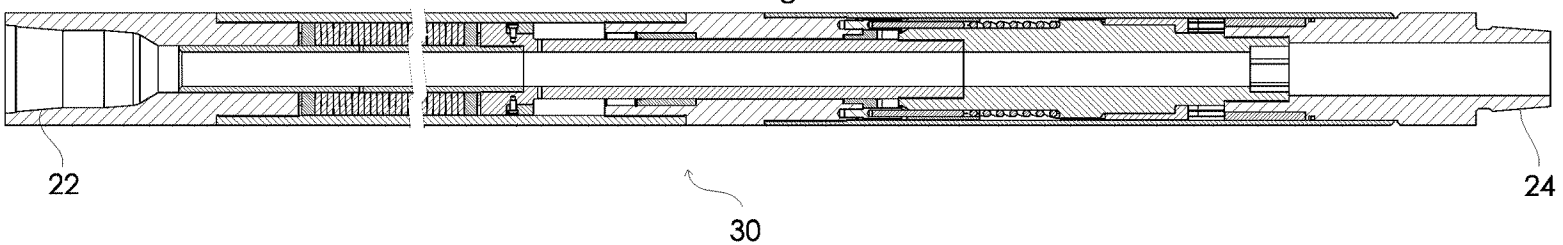
FIG. 2 is a cross sectional side view of the torque control tool of FIG. 1 wherein the torque control tool is being shown in FIG. 2 in a fully stroked in configuration resulting from relative torque occurring between the upper and the lower ends of the torque control tool being above a predetermined level (and possibly also a combination of weight being applied on bit) and thus the torque control tool is shown in a full stroked in configuration and is therefore shown at its minimum length.

The torque control tool 30 further comprises an inner mandrel 1, 7, 11, 15 which mainly consists of a bottom sub 1 provided at its in use lowermost end (the right hand end as shown in FIG. 1) which is securely connected at its upper end to the lower end of a cable fixation shaft 7 and which in turn is connected at its upper end via suitable screw threaded connections to the lower end of the compression shaft 11 and which in turn is further fixedly connected such as via suitable screw threads provided at its upper end to the lower end in use of a belleville spring shaft 15. In principle therefore and in the absence of any other components, the inner mandrel 1, 7, 11, 15 can telescopically slide in and out of the outer mandrel 14, 13, 12, 19 and thus the length of the torque control tool 30 can be increased or decreased by stroking the inner mandrel out of the outer mandrel (such as shown in FIG. 1) or stroking the inner mandrel in relative to the outer mandrel (such as shown in FIG. 2).

However, the torque control tool 30 further comprises a biasing device in the form of a stack of belleville springs 17 and which are provided in a chamber bounded at an upper end by a spacer 16 and at a lower end by a further spacer 16 in between the belleville spring housing 13 and the belleville spring shaft 15. Therefore, for the torque control tool 30 to move from the stroked out configuration of FIG. 1 to the stroked in configuration of FIG. 2, the belleville spring 17 must be compressed and therefore sufficient force must be applied between the lower end 24 and the upper end 22 in order to compress the belleville spring 17 and that force could be provided for example by letting down weight on bit by the operator at the surface of the wellbore.

In practice though, the amount of force required to compress the belleville spring 17 is relatively high and therefore it is typically the case that the torque control tool 30 will not significantly shorten or be compressed simply by applying weight on bit but even if it is then the torque control 30 will simply stroke out once the weight on bit has been reduced or removed.

Additionally, the torque control tool 30 has the great additional advantage over conventional torque control tools that, in use, it acts to absorb or dampen shocks and/or vibration generated by the drilling process by means of the stack of belleville springs 17 (for example, the belleville springs 17 will dampen or absorb such vibration and/or shocks) and therefore the torque control tool 30 not only acts to control the torque experienced by the BHA (as will be described subsequently) but also acts as a shock and/or vibration absorber (and therefore obviates the need to run a separate/additional shock absorber tool).

Figure 5:
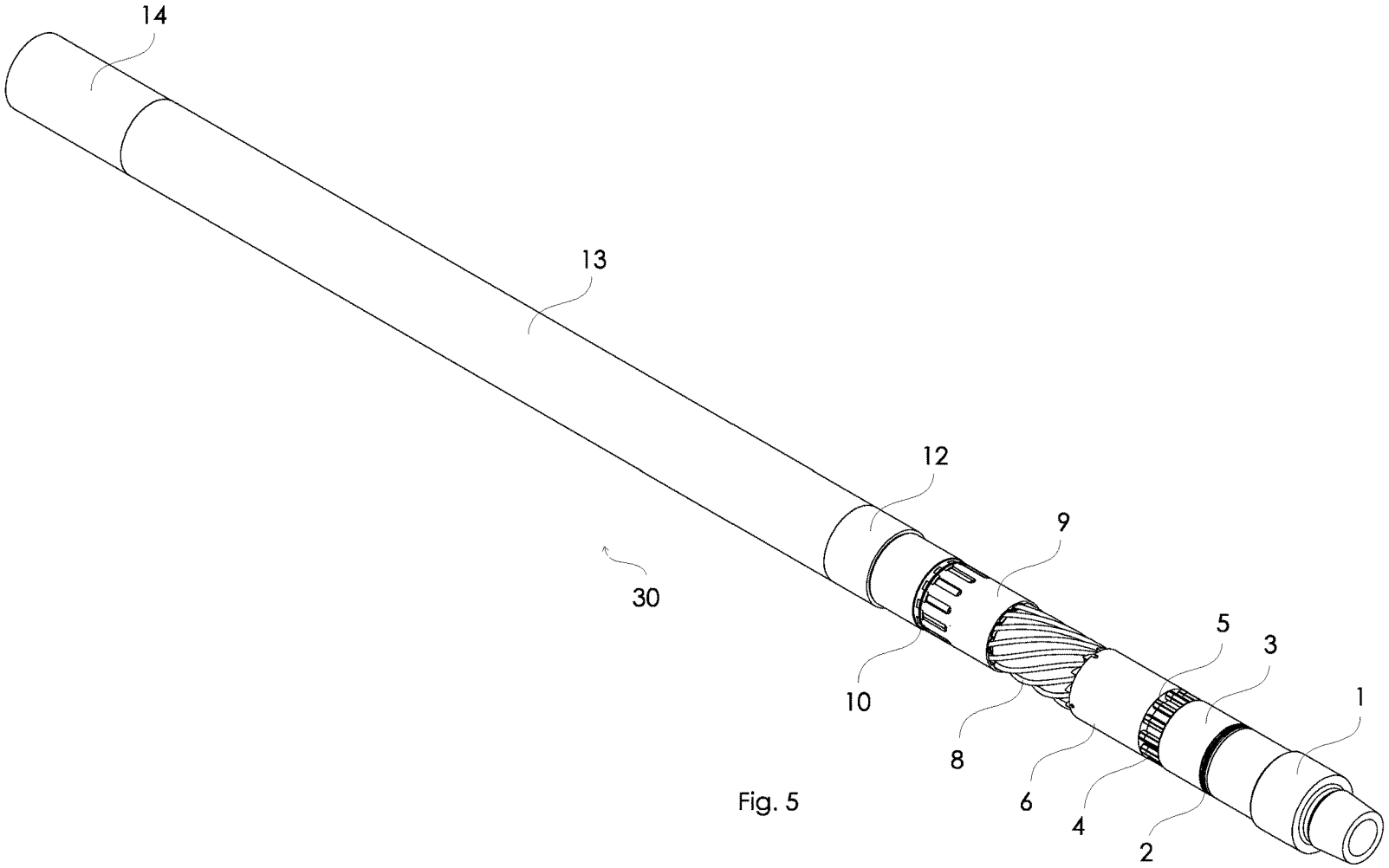
FIG. 5 is a perspective side view of the torque control tool of FIG. 4 but with a lower outer sleeve (shown as component 19 in FIG. 4) omitted so that the reader can see the internal components as assembled in situ.
Figure 6:
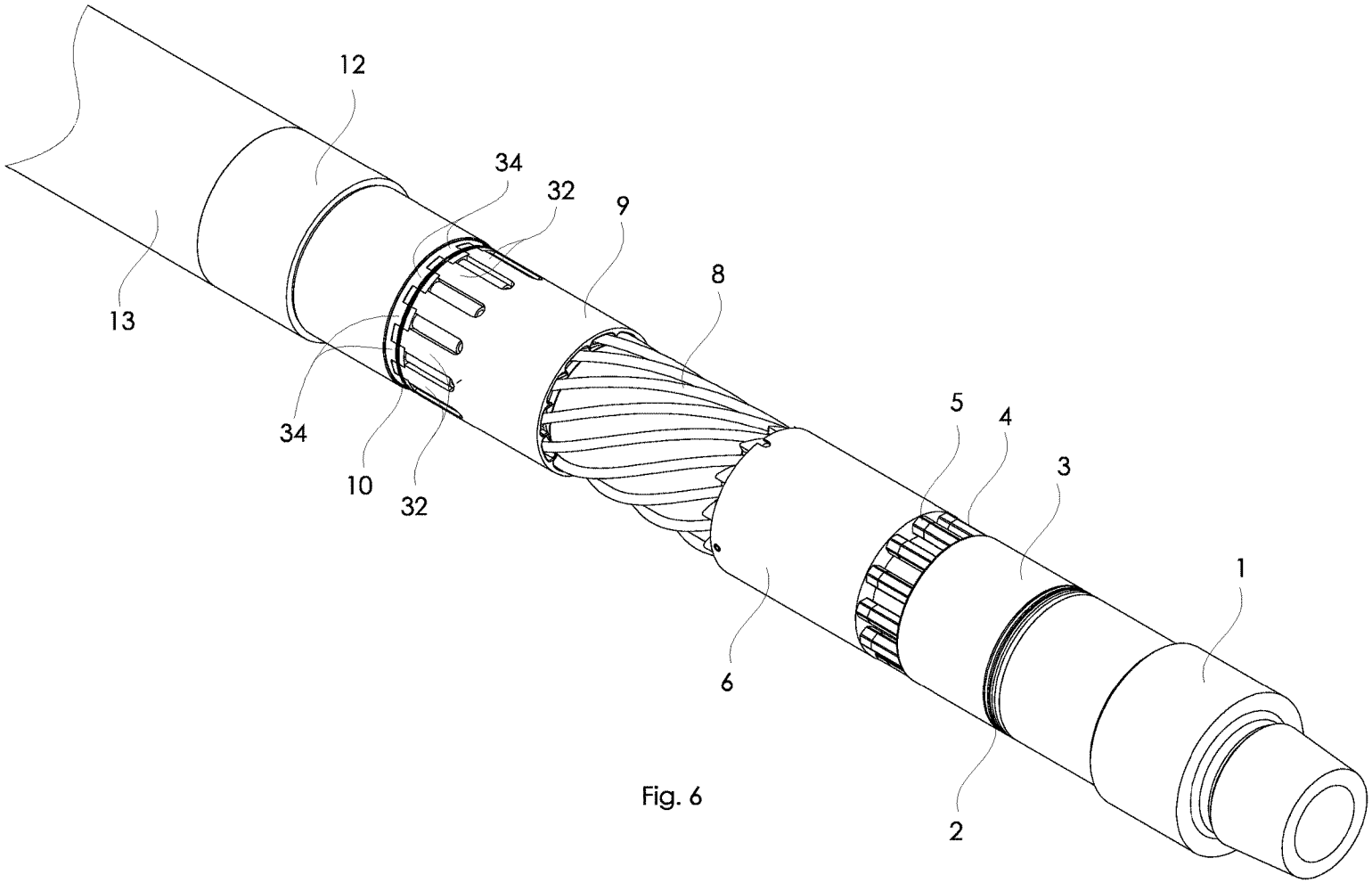
FIG. 6 is a more detailed close up perspective side view of the lower half of the torque control tool of FIG. 5.
Figure 7:
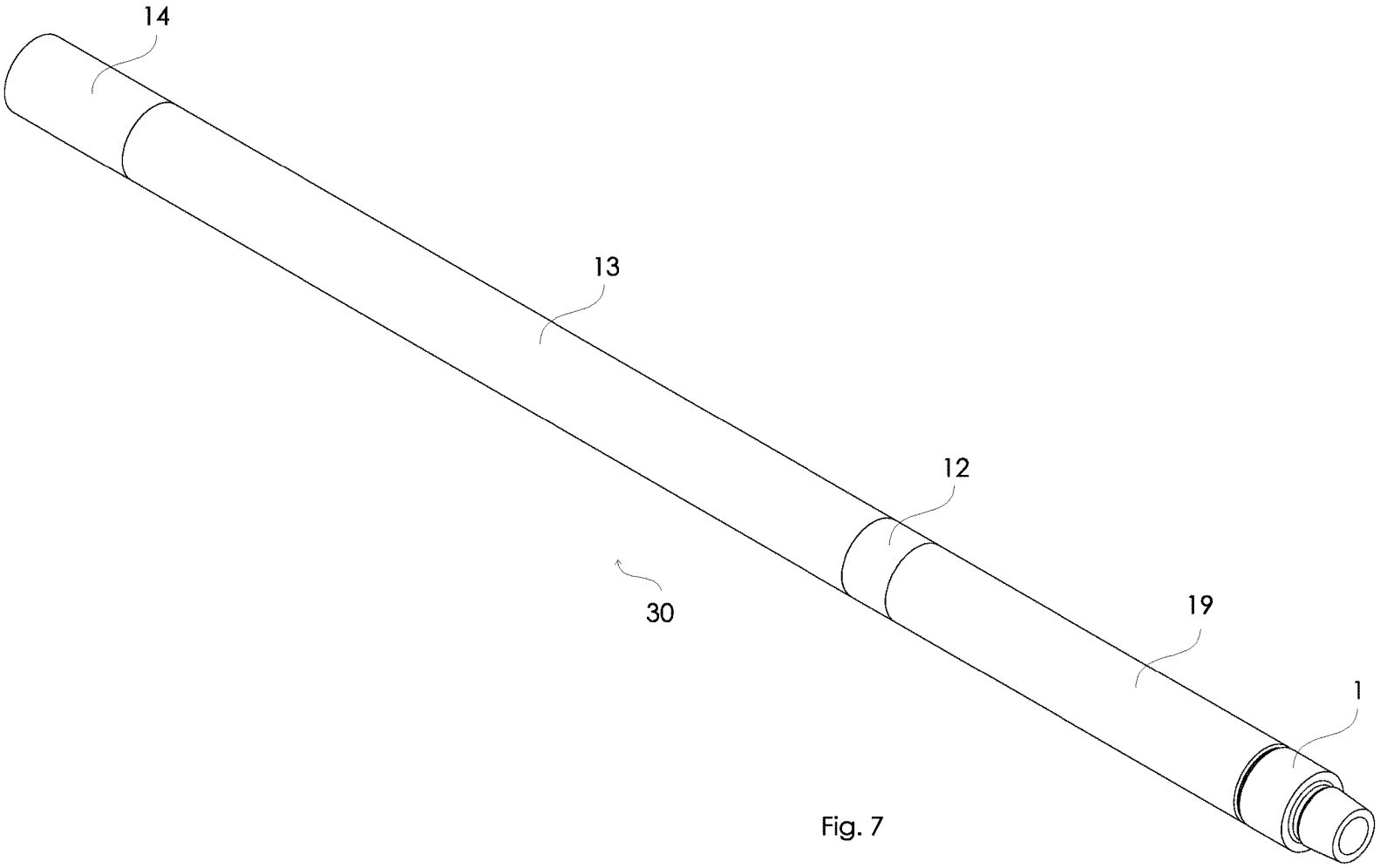
FIG. 7 is a perspective side view of the outer components of the torque control tool when in the configuration as shown in FIG. 2.
Figure 8:
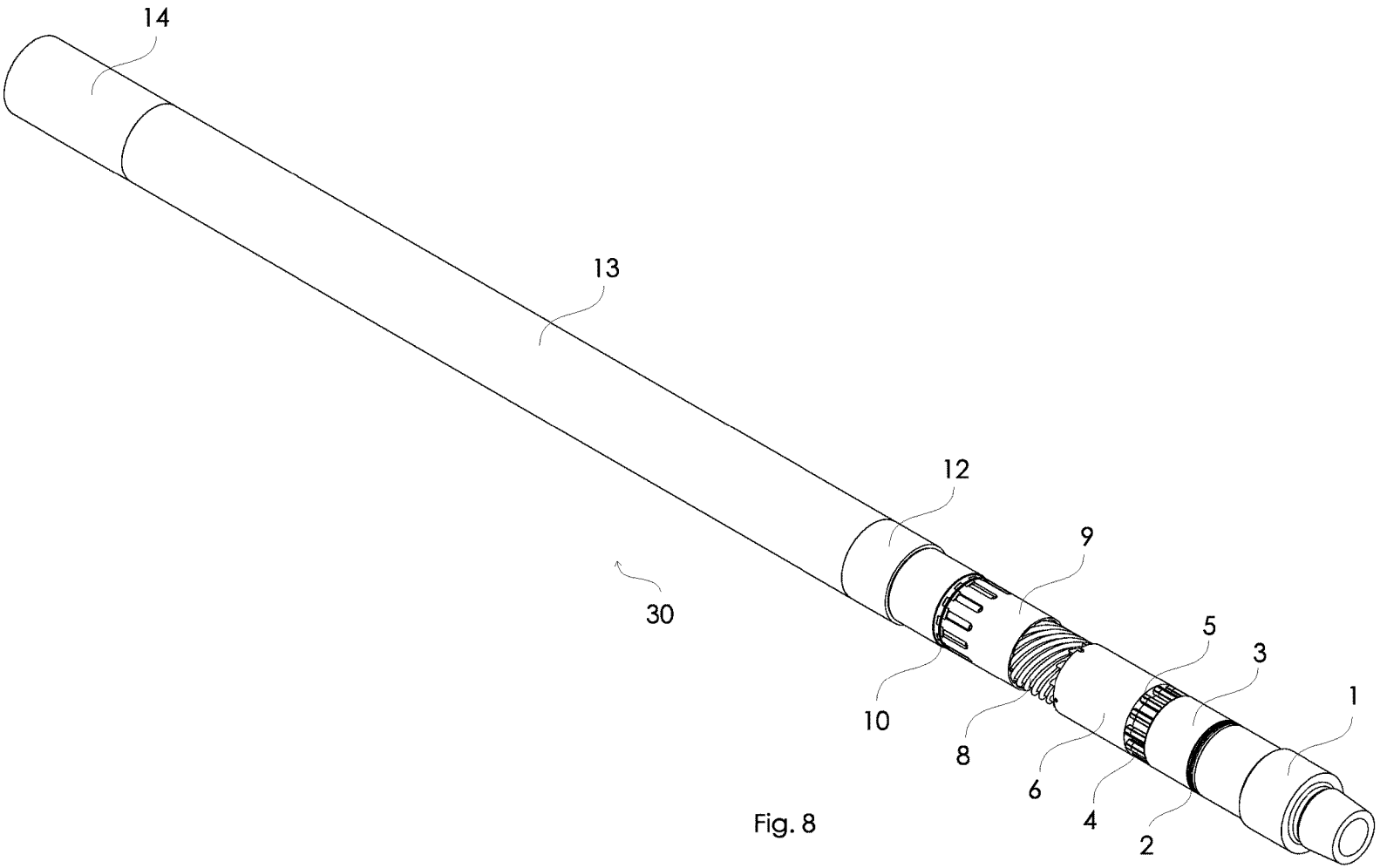
FIG. 8 is a perspective side view of the torque control tool of FIG. 7 but with the outer sleeve (shown in FIG. 7 as component 19) being omitted so that the reader can see the internal components as assembled in situ, to aid the clarity and understanding of the reader.
Figure 9:
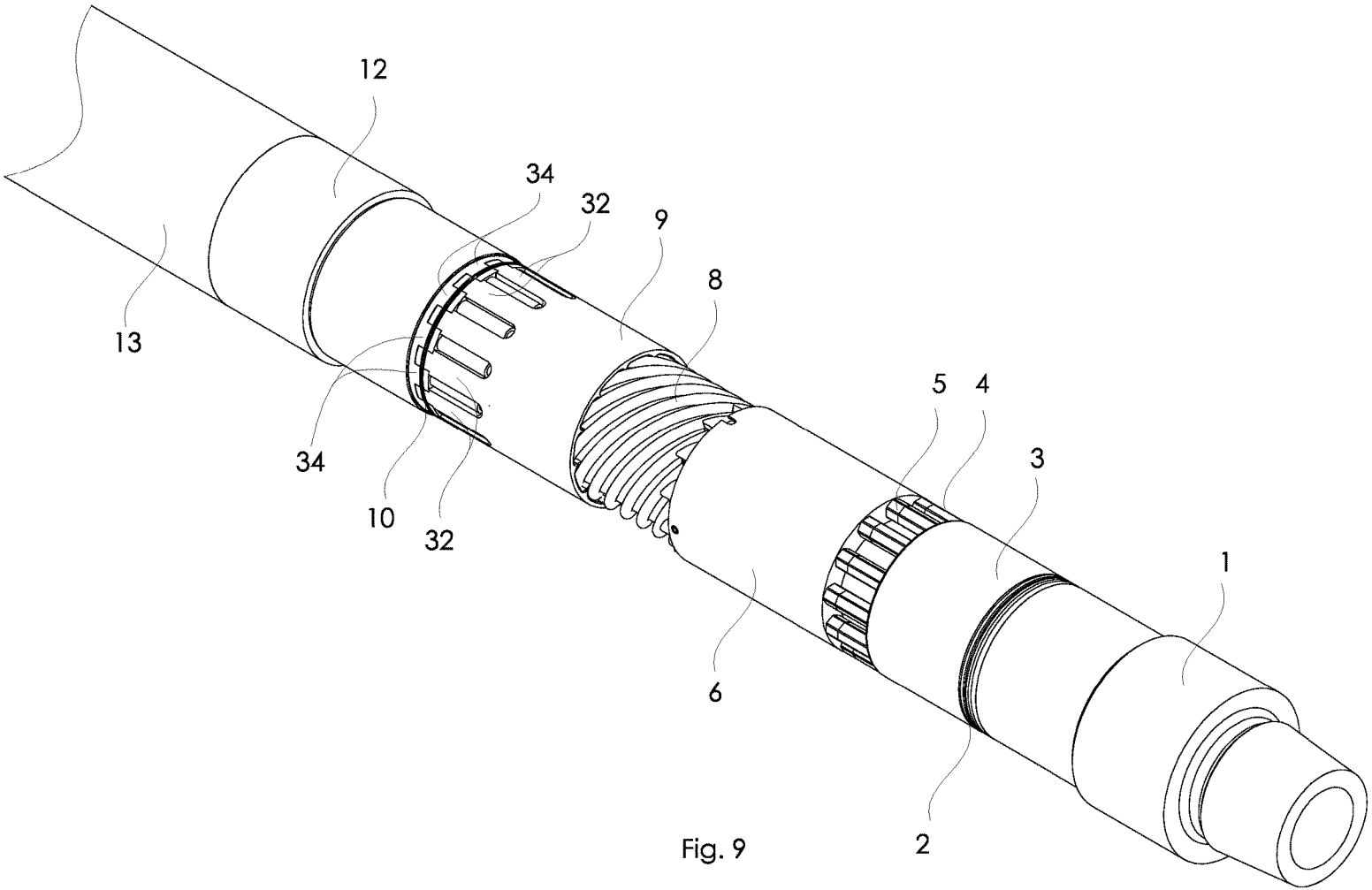
FIG. 9 is a closer up and more detailed perspective side view of the lower half of the torque control tool of FIG. 8 showing the internal components in more detail in situ in that configuration.

Importantly, a set of fixed length and relatively non elastic cables 8 are further provided in the torque control tool 30 wherein the cables 8 are flexible cables in that they may bend about their longitudinal axis but they are relatively non-elastic in terms of their longitudinal length such that they have a relatively fixed longitudinal length and therefore cannot be substantially stretched any more than their relatively fixed longitudinal length. The cables 8 act between the inner and outer mandrel in that their upper end in use are securely locked to the top cable anchor 12 by being retained by suitable connections such as "T"-slot or a suitable tongue in groove coupling formed on an outer surface of a top cable guide 9 which is further secured to the top cable anchor 12. Furthermore, the lower end of the cables 8 in use are secured by suitable connections such as a "T"-slot or suitable tongue in groove connections provided on the outer surface of a cable fixation shaft 7 which is securely connected to the bottom sub 1 via a cable fixation sleeve 6 and a set of nuts 5 and counter nuts 4 being screwed on to the lower ends of the cables 8 to further secure them in place. As can most clearly be seen in FIG. 3, the lower inner surface of the top cable guide 9 comprises curved cable guide surfaces 26 and furthermore the upper outer surface of the cable fixation shaft 7 comprises its own cable guide surfaces 28 (which are curved in the opposite direction to the curved cable guide surfaces 26) such that the respective curved cable guide surfaces 26, 28 provide support to the upper and lower respective ends of the cables 8 when the cables 8 are arranged in the helical configuration that they adopt in use of the torque control tool 30 as shown for example in FIG. 5 and in the tighter helix of the configuration shown in FIG. 8.

Figure 3:
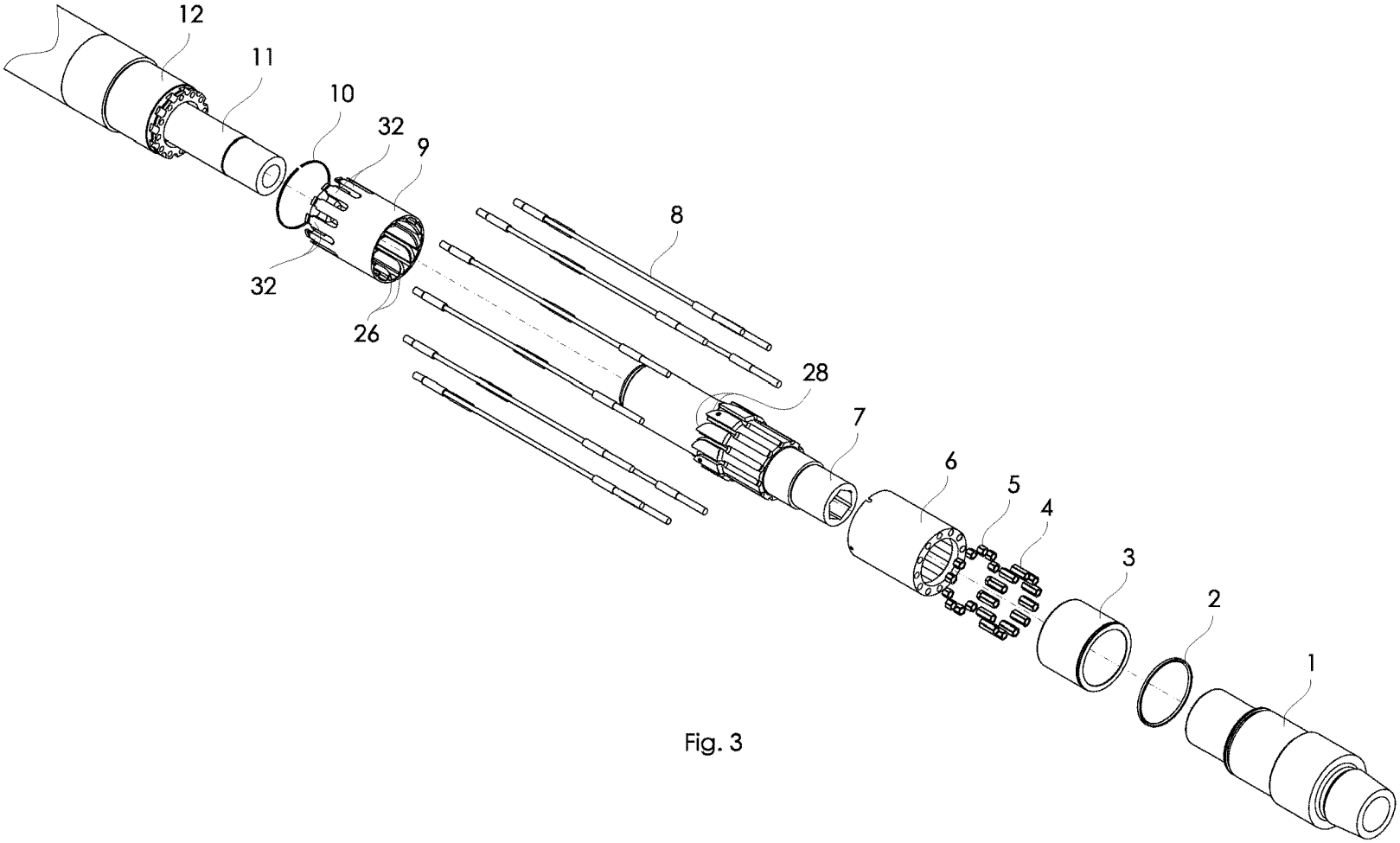
FIG. 3 is an exploded perspective view of a number of the components particularly the internal components of the lower half of the torque control tool of FIG. 1 and FIG. 2 in order to aid the understanding of the reader in terms of how those components will be arranged when the torque control tool is assembled.
Figure 4:
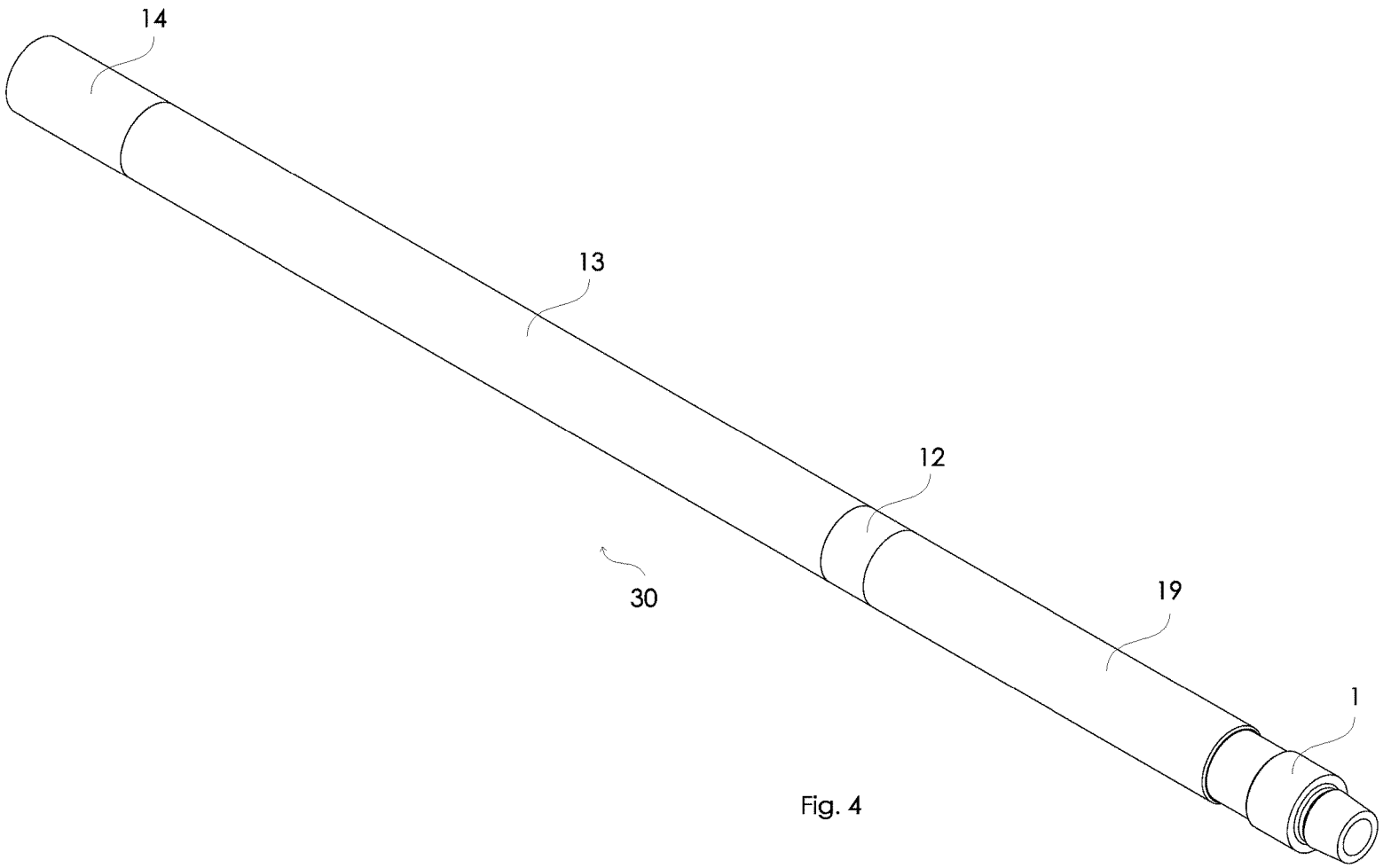
FIG. 4 is a perspective side view of the outer components of the torque control tool when in the configuration as shown in FIG. 1.

As can be most easily seen in FIG. 3, the top cable guide 9 is secured to the top cable anchor 12 by a circlip 10. As more clearly seen in FIG. 5, the circlip 10 will act to prevent longitudinal movement of the top cable guide 9 relative to the top cable anchor 12 and longitudinally extending splines 32 extending upwardly from the upper end of the top cable guide 9 and being substantially equi-spaced around the circumference thereof engage with a castellated groove and teeth 34 formation provided around the outer circumference of the top cable anchor 12 to prevent relative rotation from occurring between the top cable guide 9 and the top cable anchor 12. Furthermore, and as shown in FIG. 1 and in FIG. 3, a seal such as an O-ring seal 2 is located in a groove formed on the outer uppermost end of the bottom sub 1 and which acts against the inner through bore at the lower end of the outer sleeve 19 in order to ensure that no downhole fluids can enter into the annular side wall space between the inner and outer mandrels. There is further provided a (lower) radial bearing 3 for the inner surface of the outer sleeve 19 to bear against and therefore rotate against and therefore the lower radial bearing 3 helps prevent wear and tear of the outer sleeve 19 when it moves between the stroked out configuration of FIG. 1 and the stroked in configuration of FIG. 2. The lower radial bearing 3 is mounted and secured on the outer surface of the upper end of the bottom sub 1.

There is a further (top) radial bearing 18 provided between the top cable anchor 12 and the outer surface of the compression shaft 11 and again the top radial bearing 18 assists in preventing wear and tear occurring between the compression shaft 11 and the top cable anchor 12 when the compression shaft 11 and top cable anchor 12 either or both of rotate with respect to one another and telescopically axially move with respect to one another.

The torque control tool 30 during operation will assist in restricting the amount of torque that will be experienced by either or both of the drill bit and/or the mud motor (and any other tools) as will now be described in detail.

The torque control tool 30 in use (assuming that the relative torque occurring between the upper end 22 and the lower end 24 is below a predetermined value) will remain in the stroked out or maximum length configuration shown in FIG. 1 because the axial force generated by the cables 8 trying to shorten the axial length of the torque control tool 30 (i.e. the cables 8 trying to stroke the inner mandrel into the outer mandrel) is not sufficient enough to sufficiently compress the belleville springs 17 much more than that shown in the at rest configuration shown in FIG. 1. However, when the torque relative between the upper end 22 and lower end 24 starts to approach a pre-determined value (which is a safe margin below the maximum torque that can be experienced by the drilling mud motor and/or drill bit or any other tool in the string), the upper end of the cables 8 will continue to be rotated relative to the lower ends of the cables 8 and thus the cables will want to adopt a tighter helix than that shown in FIG. 5. Because the longitudinal length of the cables is fixed, that will then mean that the longitudinal or axial distance between the top cable guide 9 and the cable fixation shaft 7 will start to shorten. Consequently, the inner mandrel will start to be stroked into the outer mandrel and will start to move towards the fully stroked in configuration shown in FIG. 2. However, that telescopic inward stroking of the inner mandrel relative to the outer mandrel means that the belleville springs 17 will start to be compressed and thus the belleville springs 17 will resist the stroking in of the inner mandrel relative to the outer mandrel unless and until sufficient force is applied to them to overcome their biasing action. Thus, the greater the relative torque between the upper 22 and lower 24 ends of the torque control tool 30, the shorter the longitudinal length of the torque control tool 30 becomes and thus that shortening acts to lift the drill bit off the bottom of the wellbore and therefore acts to limit the amount of relative torque experienced by the string. Moreover, the cables 8 will act in use to provide a non-constant pitch, in that a given rotational arc of movement of the upper end 22 (say of 10 degrees) when the tool 30 is toward the fully stroked out configuration (FIG. 1) will produce less of a distance of stroke than the same arc distance (i.e. 10 degrees) when the tool 30 is toward the fully stroked in configuration (FIG. 2)—this is because the cables 8 act like a pendulum in a clock in that movement of the pendulum of say 10 degrees off the vertical produces less of a vertical travel than 10 degrees movement of the pendulum when it is already at for example 45 degrees off the vertical.

The torque control tool 30 has a great advantage over other conventional torque limiting or restriction devices in that there is no equivalent friction to overcome that would otherwise be acting between a screw threaded nut and bolt rotation arrangement (i.e. a lead screw arrangement) because in the torque control tool 30, the cables 8 present only minimal or no resistance to longitudinal compression of them. In simple terms, longitudinal compression of the cables 8 simply result in their folding, crumpling, curling or "scrunching up" or otherwise flexibly collapse and therefore minimal or no energy will be lost if (only) weight on bit is applied to the upper end 22 of the torque control tool 30, the belleville springs 17 of course storing the energy provided by that weight on bit. However, should sufficient torque be experienced by the upper end 22 relative to the lower end 24, the cables 8 will tighten their helix, compressing the belleville spring 17 and therefore shortening the longitudinal length of the torque control tool 30. Furthermore, the belleville spring 17 will act to return the torque control tool 30 from the stroked in configuration of FIG. 2 to the stroked out configuration of FIG. 1 once the relative torque acting between the upper end 22 and the lower end 24 has been reduced or removed and therefore will act to return the drill bit to the face of the wellbore to be cut. Consequently, the cables 8 are adapted to transfer force in one axial direction (i.e. tension) but not in the other (i.e. compression) and so can be thought of as being inelastic in tension but not in compression.

Modifications and improvements may be made to the embodiments hereinbefore described without departing from the scope of the invention. For example, other suitable types of springs or biasing devices could be employed in place of the belleville spring 17. Furthermore, other longitudinal elongate members that are substantially non-elastic could be used instead of the cables 8 and advantageously such other longitudinally elongate members would also be flexible and non-resistive in terms of their lateral (off longitudinal) movement.

The invention claimed is:

1. A downhole tool comprising an inner mandrel:

an outer mandrel, and a coupling mechanism to couple the inner and the outer mandrel, the coupling mechanism comprising a plurality of longitudinally elongate members acting between the inner and outer mandrel, wherein the longitudinally elongate members comprise cables having a longitudinal length greater than their diameter;

wherein the plurality of cables are arranged around the longitudinal axis of the downhole tool;

wherein one end of the plurality of cables is securely mounted to the inner mandrel and the other end of the plurality of cables is securely mounted to the outer mandrel;

wherein the plurality of cables are fixed in their longitudinal length when tension is applied to one end relative to another such that the cables resist the tension applied along their length, but wherein said cables permit relative compressive longitudinal movement occurring between the inner and outer mandrels and said cables do not resist relative compressive longitudinal movement occurring between the inner and outer mandrels such that the plurality of cables provide a differential in their reaction to tension and compression;

wherein the coupling mechanism permits at least a degree of relative rotational movement between the inner and outer mandrel;

the downhole tool further comprising a biasing device acting between the inner and outer mandrel, wherein the biasing device is a separate component from the plurality of cables; and wherein the coupling mechanism is arranged such that compression of the inner and outer mandrels results in the plurality of cables flexibly collapsing, but said compression does not result in relative rotation of the inner and outer mandrels.

2. A downhole tool according to claim 1, wherein compression of the inner and outer mandrels results in telescoping movement of the inner mandrel into the outer mandrel without resulting in relative rotation of the inner and outer mandrels.

3. A downhole tool according to claim 1, wherein the coupling mechanism permits relative rotational movement between the inner and outer mandrels between a first configuration in which the downhole tool is un-torqued and a second configuration in which the downhole tool is fully torqued.

4. A downhole tool according to claim 3, wherein when the tool is in the second configuration the inner mandrel is stroked into the outer mandrel.

5. A downhole tool according to claim 1, wherein the plurality of cables will collapse when compressed at one end relative to the other.

6. A downhole tool according to claim 1, wherein the plurality of cables are inelastic when in tension and do not increase in longitudinal length when tension is applied to one end relative to another.

7. A downhole tool according to claim 1, wherein the downhole tool is adapted to be included in a downhole tool string comprising a downhole drill bit.

8. A downhole tool according to claim 7, wherein the downhole tool is adapted to be included in a downhole tool string further comprising a downhole mud motor.

9. A downhole tool according to claim 1, wherein the plurality of cables are arranged equi-spaced around a co-diameter of the longitudinal axis of the downhole tool.

10. A downhole tool according to claim 1, wherein:

the plurality of cables are arranged equi-spaced around a co-diameter of the longitudinal axis of the downhole tool such that the upper ends of the plurality of cables terminate on an upper plane that is perpendicular to the longitudinal axis of the downhole tool and the lower ends of the plurality of cables terminate on a lower plane that is perpendicular to the longitudinal axis of the downhole tool; and wherein the upper and lower planes are spaced apart by a longitudinal distance between the said upper and lower ends; and relative rotation of the said upper ends on their upper plane about the longitudinal axis of the downhole tool with respect to the lower ends on their lower plane results in the plurality of cables comprising a helical configuration having a first longitudinal distance between the upper and lower planes.

11. A downhole tool according to claim 10, wherein further relative rotation of the upper ends on their upper plane about the longitudinal axis of the downhole tool with respect to the lower ends on their lower plane results in the plurality of cables comprising a tighter helical configuration having a second longitudinal distance between the upper and lower planes.

12. A downhole tool according to claim 11, wherein the said second longitudinal distance is shorter than the said first longitudinal distance.

13. A downhole tool according to claim 10, wherein the plurality of cables are arranged such that their pitch is not constant.

14. A downhole tool according to claim 10, wherein the pitch of the plurality of cables increases as the inner mandrel telescopes or strokes further into the outer mandrel.

15. A downhole tool according to claim 1, wherein rotation of the upper end of the plurality of cables relative to the lower end results in the inner mandrel being pulled or stroked into the outer mandrel thereby decreasing the length of the downhole tool and thereby reducing the torque experienced by one or more other components included in the same downhole tool string as the downhole tool.

16. A downhole tool according to claim 1, wherein the downhole tool is a torque restriction tool.

17. A downhole tool according to claim 1, wherein the biasing device acts to bias the inner mandrel out of the outer mandrel and acts to resist relative compressive movement of the inner mandrel into the outer mandrel.

18. A downhole tool according to claim 1, wherein the biasing device comprises one or more spring devices.

19. A downhole tool according to claim 18, wherein the one or more spring devices comprises a plurality of belleville springs.

20. A downhole tool according to claim 1, wherein the biasing device is arranged to enable rotation of the inner mandrel relative to the outer mandrel once a level of relative torque is experienced by the inner and outer mandrel and thus the biasing device permits the said rotation of one end of the plurality of cables relative to the other.

21. A downhole tool according to claim 1, wherein the biasing device is arranged to enable rotation of the inner mandrel relative to the outer mandrel once a pre-determined level of relative torque is experienced by the inner and outer mandrel and thus the biasing device permits the said rotation of one end of the plurality of cables relative to the other.

22. A downhole tool according to claim 1 wherein the downhole tool comprises a downhole torque control tool.

23. A downhole tool according to claim 1 wherein the downhole tool comprises a downhole shock absorber tool.

24. A downhole tool according to claim 1 wherein the downhole tool comprises a downhole axial vibration dampener tool.

25. A downhole tool according to claim 1 wherein the downhole tool comprises a downhole torsion control tool.

26. A downhole tool according to claim 1 wherein the downhole tool comprises a downhole torsional vibration dampener tool.

27. A downhole tool according to claim 1 wherein the downhole tool comprises a combined downhole torque control, torsional control and axial vibration dampener.

28. A downhole tool according to claim 1, wherein the biasing device is arranged to absorb or dampen shock and/or vibration experienced by the downhole tool in use, and therefore provides the tool with a dual shock absorbing and torque control function.

29. A downhole tool according to claim 1, wherein the inner mandrel is arranged telescopingly within the outer mandrel.

* * * * *